US009527325B2

(12) United States Patent
Sun

(10) Patent No.: US 9,527,325 B2
(45) Date of Patent: Dec. 27, 2016

(54) MEDIA ALIGNMENT

(71) Applicant: HEWLETT-PACKARD DEVELOPMENT COMPANY, L.P., Houston, TX (US)

(72) Inventor: Bo Yuan Sun, Shanghai (CN)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/759,868

(22) PCT Filed: Jan. 14, 2013

(86) PCT No.: PCT/CN2013/070404

§ 371 (c)(1),
(2) Date: Jul. 8, 2015

(87) PCT Pub. No.: WO2014/107897

PCT Pub. Date: Jul. 17, 2014

(65) Prior Publication Data

US 2015/0352874 A1 Dec. 10, 2015

(51) Int. Cl.

| | |
|---|---|
| ***B41J 2/13*** | (2006.01) |
| ***B41J 11/00*** | (2006.01) |
| ***B41J 29/393*** | (2006.01) |

(52) U.S. Cl.

CPC ..... *B41J 29/393* (2013.01); *B41J 2/13* (2013.01); *B41J 11/008* (2013.01); *B41J 2029/3935* (2013.01)

(58) Field of Classification Search

CPC ..... B41J 29/393; B41J 2/13; B41J 11/008; B41J 2029/3935

See application file for complete search history.

(56) References Cited

U.S. PATENT DOCUMENTS

| | | | |
|---|---|---|---|
| 6,554,390 | B2 | 4/2003 | Arquilevich et al. |
| 7,044,573 | B2 | 5/2006 | King et al. |

(Continued)

FOREIGN PATENT DOCUMENTS

| | | | |
|---|---|---|---|
| CN | 102310634 | A | 1/2012 |
| JP | 2005246650 | A | 9/2005 |

OTHER PUBLICATIONS

Notenboom, et al. "Mechatronic design of an active printhead alignment mechanism for wide format printing systems." ScienceDirect. Oct. 16, 2006.

(Continued)

*Primary Examiner* — Bradley Thies
(74) *Attorney, Agent, or Firm* — HP Inc. Patent Department

(57) ABSTRACT

A media alignment method includes printing a calibration pattern on a media in a print one by a printhead including forming a first corner identification marker at a first corner of a reference edge of the media, a second corner identification marker at a second corner of the reference edge, and a linear identification marker. The method also includes capturing the calibration pattern by an image capturing unit. The method also includes determining a printhead axis based on the linear identification marker, determining a default printhead origin based on the printhead axis and the linear identification marker, and determining a media origin based on the printhead axis, the first corner identification marker, and the second corner identification marker. The method also includes determining an offset compensation parameter by the determination module corresponding to a distance between the default printhead origin and the media origin.

11 Claims, 6 Drawing Sheets

(56) References Cited

U.S. PATENT DOCUMENTS

| | | | | |
|---|---|---|---|---|
| 7,898,695 | B1 | 3/2011 | Damon et al. | |
| 2002/0030704 | A1 | 3/2002 | Korngold et al. | |
| 2003/0030686 | A1 | 2/2003 | Abe et al. | |
| 2003/0156148 | A1* | 8/2003 | King | B41J 29/393 347/19 |
| 2003/0189610 | A1* | 10/2003 | Darby | B41J 2/17566 347/19 |
| 2003/0236973 | A1* | 12/2003 | Nelson | G03G 15/507 713/2 |
| 2004/0196357 | A1* | 10/2004 | Tasaka | B41C 1/1083 347/248 |
| 2009/0316164 | A1 | 12/2009 | Takahashi et al. | |
| 2010/0121468 | A1 | 5/2010 | Pasch et al. | |
| 2011/0273504 | A1* | 11/2011 | Boesten | B41J 2/2128 347/14 |
| 2011/0316925 | A1* | 12/2011 | Saita | B41J 3/60 347/19 |
| 2012/0098879 | A1* | 4/2012 | Mandel | B41J 11/0095 347/16 |
| 2012/0262750 | A1* | 10/2012 | Kinoshita | G06K 15/1247 358/1.14 |

OTHER PUBLICATIONS

PCT Search Report ~ Application No. PCT/CN2013/070404, dated Oct. 24, 2013.

* cited by examiner

MEDIA ALIGNMENT

BACKGROUND

Printing systems such as inkjet printers form images on media. Inkjet printers may include a printhead having nozzles to eject ink drops therefrom.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Printing systems such as inkjet printers form images on media. Inkjet printers may include a printhead having nozzles to eject ink drops therefrom. Periodically, the images may not be printed at the intended location on the media due to misalignment of the image with respect to the media. Accordingly, the image on the media may exhibit image horizontal shift and/or image skew resulting in a variation in sizes of respective margins due to the resulting location and/or orientation of the image printed on the media. That is, the image horizontal shift may result in a first width of a first side margin being different than a second width of a second side margin of the media. The image skew may result in an image being rotated with respect to the media. For example, a respective image edge may form a skew angle with respect to a corresponding media edge resulting in the respective image edge and the corresponding media edge not being parallel with each other. Dedicated alignment sensors may be used to identify and/or reduce media misalignment. However, dedicated alignment sensors may increase the cost and hardware complexity of the printing system.

In examples, a media alignment method of a printing system may include printing a calibration pattern on a media in a print zone by a printhead including forming a first corner identification marker at a first corner of a reference edge of the media, a second corner identification marker at a second corner of the reference edge, and a linear identification marker. The method may also include capturing the calibration pattern by an image capturing unit. The method may also include determining a printhead axis, a default printhead origin, and a media origin by the determination module.

The printhead axis may be a line axis in a print zone projected from a trajectory of a printhead in a swath movement. The default printhead origin may be a reference point on a printhead axis corresponding to a theoretical media location used by a printhead to match positions of print content and media in a print job. The media origin may be a reference point on a media along a printhead axis indicative of an actual position of the media in a print zone. The distance $d_o$, for example, may be a length by which the default printhead origin and the media origin are offset from each other. The method may also include determining an offset compensation parameter and an angular compensation parameter by the determination module. Accordingly, the determination of the offset compensation parameter and/or the angular compensation parameter may be used to address media misalignment without the use of dedicated alignment sensors. Thus, an increase in cost and hardware complexity to address media alignment may be reduced.

Figure 1A:
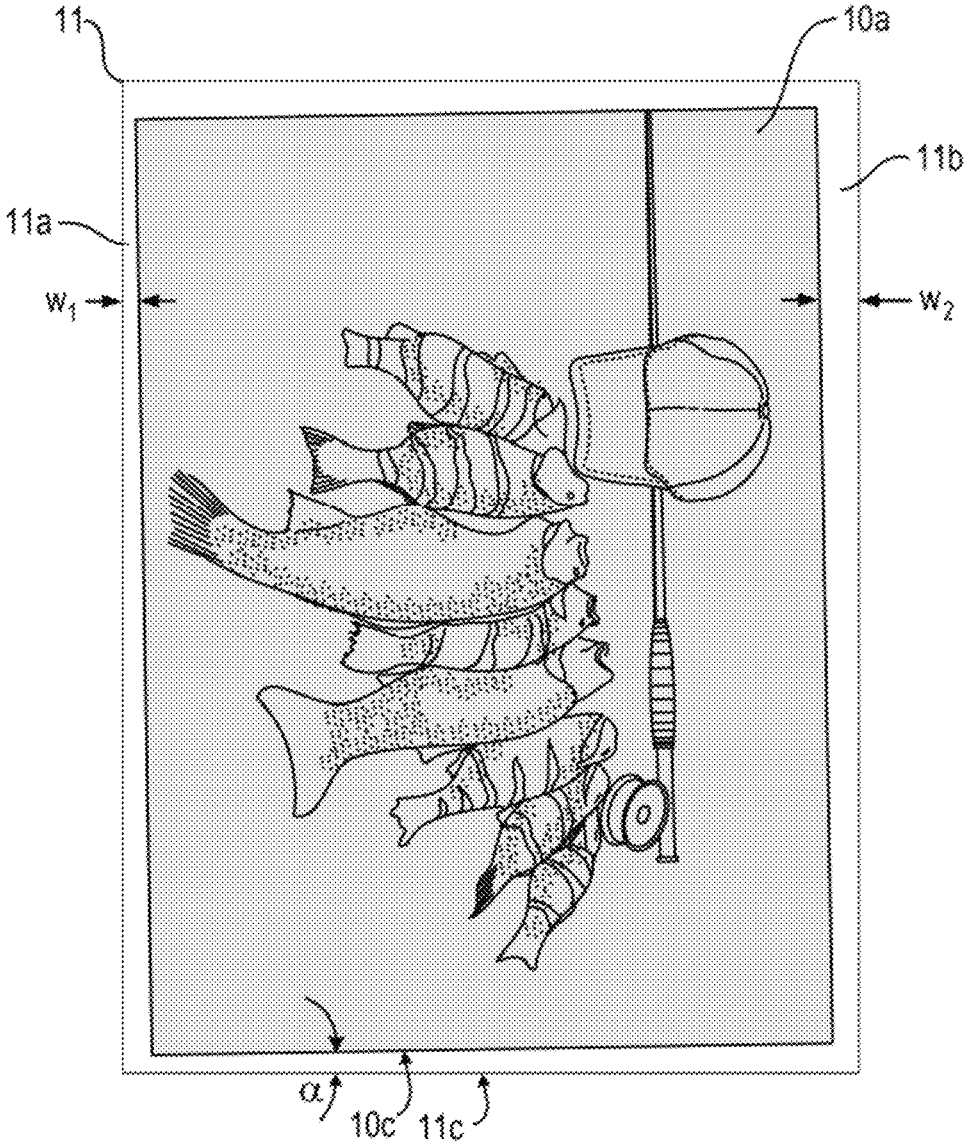
FIG. 1A is a schematic view illustrating a misaligned image on media according to an example.
Figure 1B:
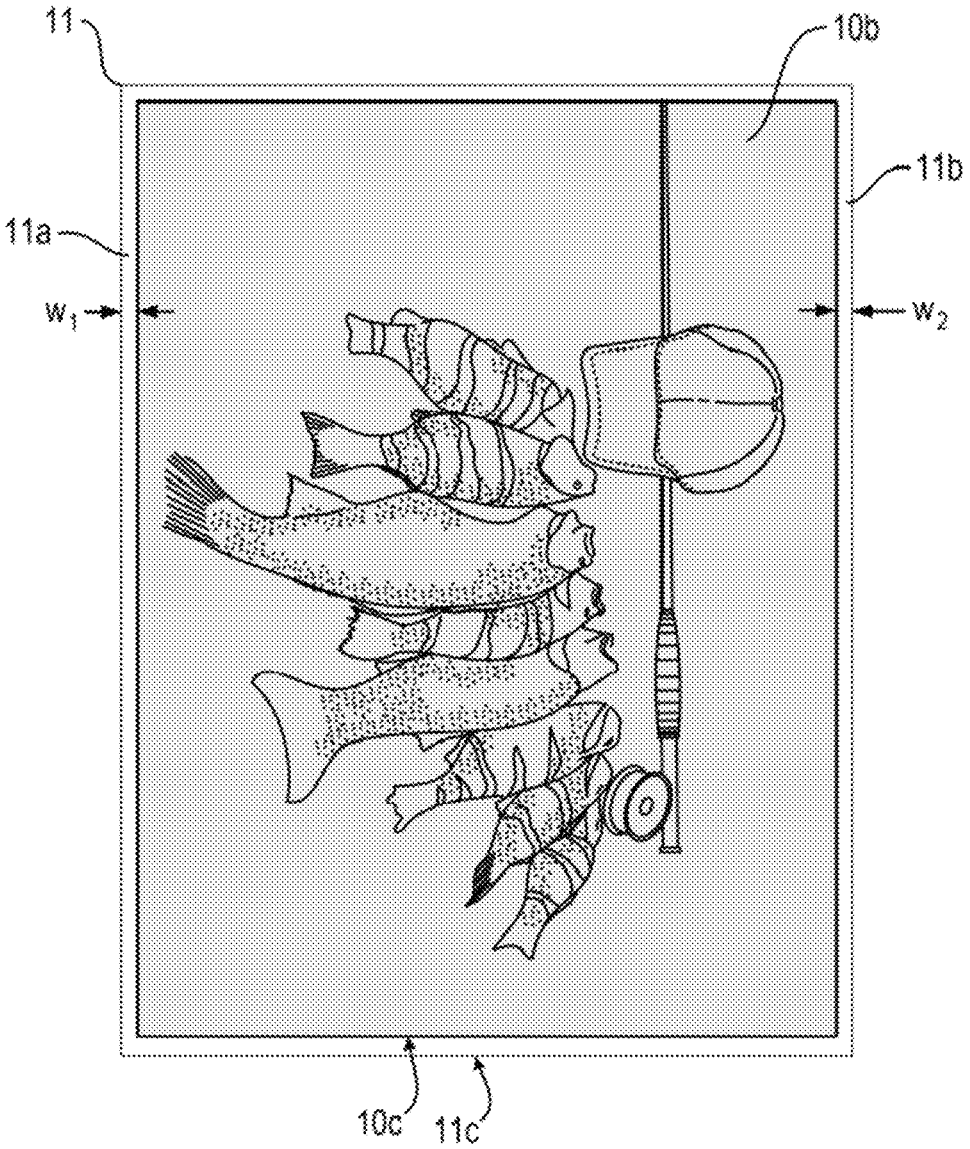
FIG. 1B is a schematic view illustrating an alignment-compensated image processed and printed on media by a printing system of FIG. 2 according to an example.

FIG. 1A is a schematic view illustrating a misaligned image printed on media according to an example. FIG. 1B is a schematic view illustrating an alignment-compensated image printed on media by a printing system of FIG. 2 according to an example. Referring to FIG. 1A, a misaligned image 10*a* is printed on a media 11. That is, the misaligned image 10*a* is not located and oriented at a center of the media 11 as intended. For example, in FIG. 1A, image horizontal shift is illustrated with respect to the misaligned image 10*a* on the media 11 such that a first width $w_1$ of a first side margin 11*a* and a second width $w_2$ of a second side margin 11*b* of the media 11 are unequal. Additionally, in FIG. 1A, image skew is illustrated with respect to the misaligned image 10*a* on the media 11 such that the misaligned image 10*a* is rotated with respect to the media 11. Accordingly, a skew angle $\alpha$ is formed between a respective image edge 10*c* and a corresponding media edge 11*c* resulting in the respective edges 10*c* and 11*c* not being parallel with each other.

Alternatively, as illustrated in FIG. 1B, an alignment-compensated image 10*b* is printed on the media 11 such that the first width $w_1$ of the first side margin 11*a* and the second width $w_2$ of the second side margin 11*b* are substantially equal. Further, the alignment-compensated image 10*b* is not rotated with respect to its intended location and orientation on the media 11. Accordingly, the respective edges 10*c* and 11*c* are substantially parallel with each other.

Figure 2:
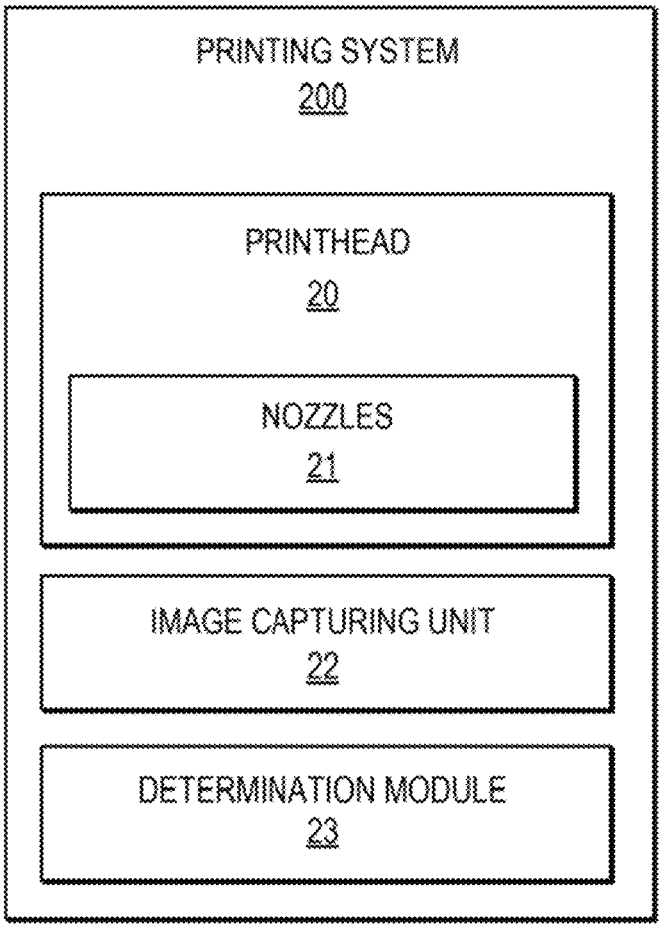
FIG. 2 is a block diagram illustrating a printing system according to an example.
Figure 3:
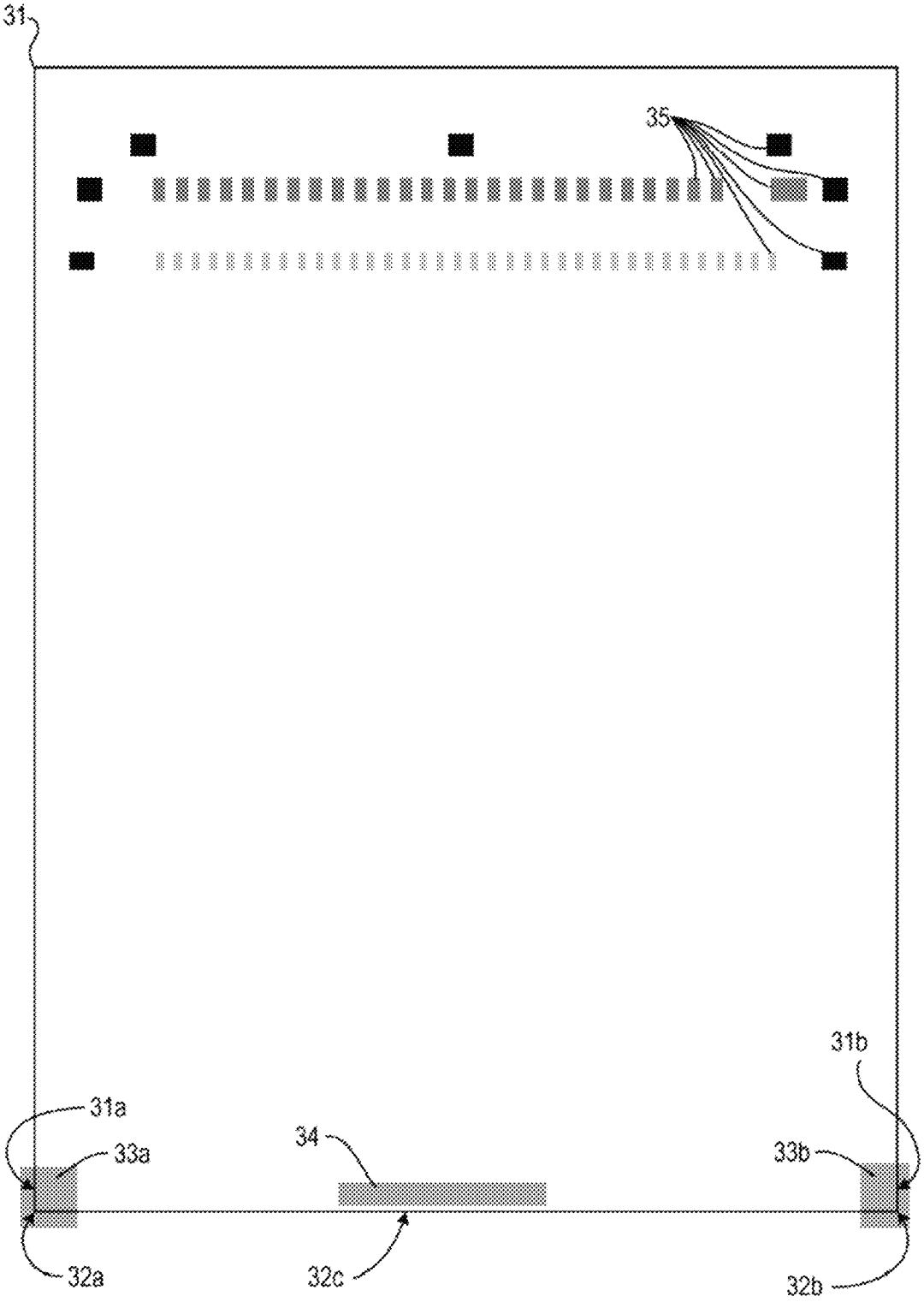
FIG. 3 is a top view illustrating a calibration pattern printed on media by the printing system of FIG. 2 according to an example.

FIG. 2 is a block diagram illustrating a printing system according to an example. FIG. 3 is a top view illustrating a calibration pattern printed on a media by the printing system of FIG. 2 according to an example. Referring to FIGS. 2 and 3, in some examples, a printing system 200 may include a printhead 20 having nozzles 21, an image capturing unit 22, and a determination module 23. The printhead 20 may print a calibration pattern on a media 31 in a print zone to form a first corner identification marker 33*a* at a first corner 32*a* of a reference edge 32*c* of the media 31, a second corner identification marker 33*b* at a second corner 32*b* of the reference edge 32*c*, a linear identification marker 34, and nozzle alignment identification markers 35. In some examples, the reference edge 32*c* may correspond to a media leading edge, a media trailing edge, and the like. For example, the media leading edge may correspond to the first media edge to arrive at a print zone. Alternatively, the media trailing edge may correspond to the last media edge to leave the print zone. In some examples, the printhead 20 may include at least one of a plurality of printhead modules, a print bar, an integrated printhead, a printhead assembly, and/or the like.

Figure 4:
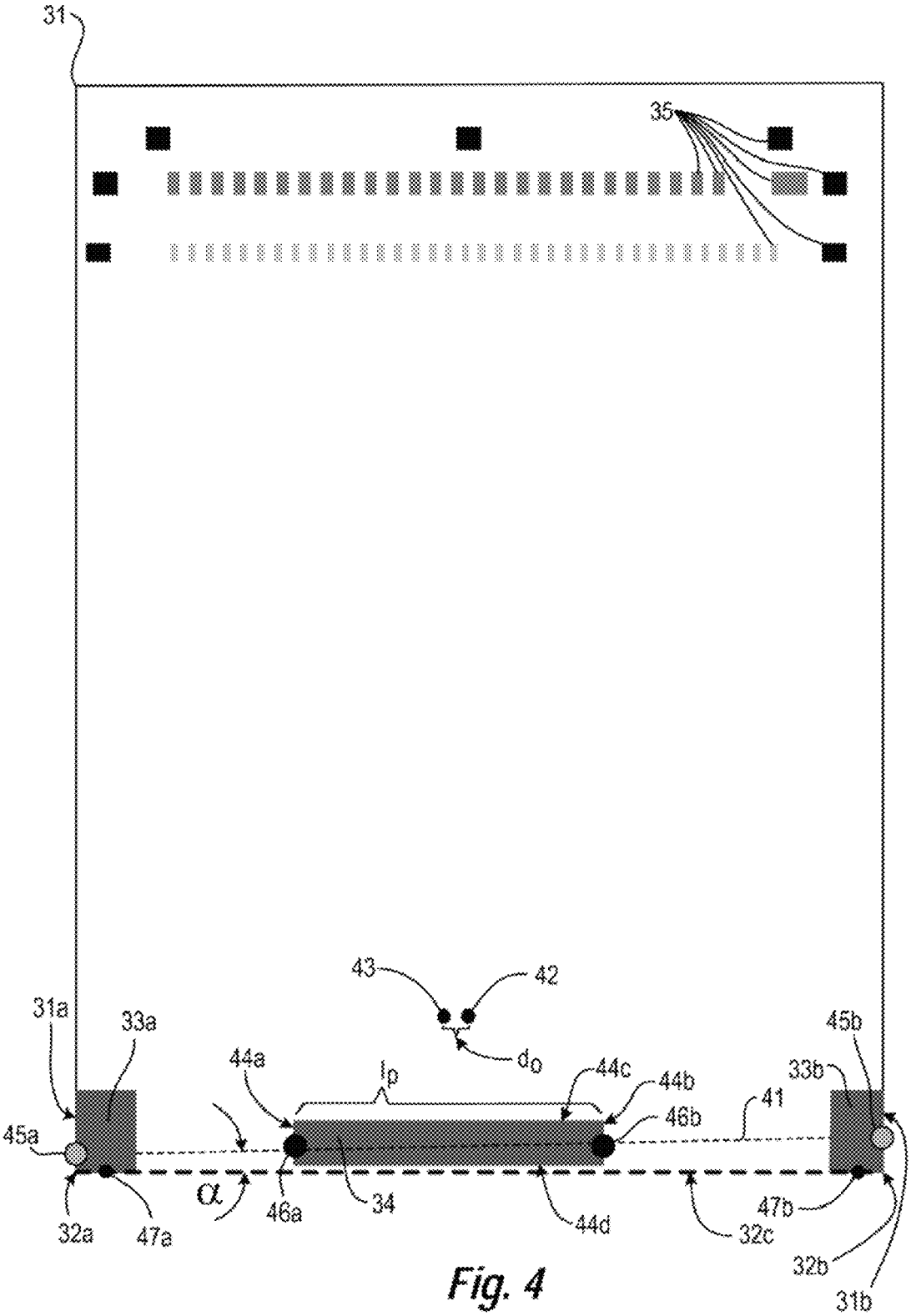
FIG. 4 is a representation of a calibration pattern and data processed by the printing system of FIG. 2 according to an example.

Referring to FIGS. 2 and 3, in some examples, the image capturing unit 22 may capture the calibration pattern to identify the first corner identification marker 33*a*, the second corner identification marker 33*b*, the linear identification marker 34, and the nozzle alignment identification markers 35. For example, the image capturing unit 22 may include a scanner to scan the calibration pattern. In some examples, the printing system 200 may prompt a user to initiate capturing of the calibration pattern printed by the printhead 20 by the image capturing unit 22. Referring to FIGS. 2-4, in some examples, the determination module 23 may determine a printhead axis 41, a default printhead origin 42, a media origin 43, and an offset compensation parameter.

The determination module 23 may determine the printhead axis 41 based on the linear identification marker 34, the default printhead origin 42 based on the printhead axis 41 and the linear identification marker 34, the media origin 43 based on the printhead axis 41 and the first and second corner identification markers 33*a* and 33*b*, and the offset compensation parameter corresponding to a distance $d_o$ between the default printhead origin 42 and the media origin 43. In some examples, the determination module 23 may determine the printhead axis 41, the default printhead origin 42, the media origin 43, and the offset compensation parameter by processing data in firmware, and the like.

In some examples, a determination module 23 may be implemented in hardware, software including firmware, or combinations thereof. The firmware, for example, may be stored in memory and executed by a suitable instruction-execution system. If implemented in hardware, as in an alternative example, the determination module 23 may be implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In other examples, the determination module 23 may be implemented in a combination of software and data executed and stored under the control of a computing device.

Referring to FIGS. 2 and 3, in some examples, the calibration pattern on the media 31 printed by the printing system 200 may include a first corner identification marker 33*a*, a second corner identification marker 33*b*, a linear identification marker 34, and nozzle alignment identification markers 35. The first corner identification marker 33*a* may be formed at a first corner 32*a* of a reference edge 32*c* of the media 31. For example, the first corner 32*a* of the reference edge 32*c* of the media 31 may be tinted by forming a first swath through overspraying fluid at the first corner 32*a* by the printhead 20. The second corner identification marker 33*b* may be formed at a second corner 32*b* of the reference edge 32*c* of the media 31. For example, the second corner 32*b* of the reference edge 32*c* of the media 31 may be tinted by forming a second swath through overspraying fluid at the second corner 32*b* by the printhead 20. The linear identification marker 34, for example, may be a rectangular swath having a marker leading edge 44*d*, a marker trailing edge 44*c*, a first marker side edge 44*a*, a second marker side edge 44*b*, and a predetermined length $l_p$ as illustrated in FIG. 4. The nozzle alignment identification markers 35 may include a plurality of marks to be captured by the printing system 200 to calibrate printhead nozzles 21.

FIG. 4 is a representation of a calibration pattern and data processed by the printing system of FIG. 2 according to an example. Referring to FIG. 4, in some examples, the processed data may include a printhead axis 41, a default printhead origin 42, a media origin 43, a skew angle α, an angular compensation parameter, and an offset compensation parameter. The printhead axis 41 may be determined based on the linear identification marker 34. The default printhead origin 42 may be determined based on the printhead axis 41 and the linear identification marker 34. For example, a first pair of intersection points including a first point 46*a* and a second point 46*b* may be determined. The first point 46*a* may be located at an intersection of the printhead axis 41 and the first marker side edge 44*a* of the linear identification marker 34. The second point 46*b* may be located at an intersection of the printhead axis 41 and the second marker side edge 44*b* of the linear identification marker 34.

The media origin 43 may be determined based on the printhead axis 41 and the first and second corner identification markers 33*a* and 33*b*. For example, a second pair of intersection points including a third point 45*a* and a fourth point 45*b* may be determined. The third point 45*a* may be located at an intersection of the printhead axis 41 and a first media side edge 31*a* of the media 31 within the first corner identification marker 33*a*. The fourth point 45*b* may be located at the printhead axis 41 and a second media side edge 31*b* of the media 31 within the second corner identification marker 33*b*. The offset compensation parameter may be determined based on a distance $d_o$ between the default printhead origin 42 and the media origin 43. For example, the offset compensation parameter may correspond to an offset distance between the default printhead origin 42 and the media origin 43 due to tolerances and variances of components of the respective printing system 200.

Referring to FIG. 4, in some examples, the reference edge 32*c* of the media 31 may be identified based on the first and second corner identification markers 33*a* and 33*b* to determine an angular compensation parameter corresponding to a skew angle α formed by the printhead axis 41 and the reference edge 32*c* of the media 31. For example, edge points 47*a* and 47*b* may be detected within the first and second corner identification markers 33*a* and 33*b* on the reference edge 32*c* of the media 31, respectively, such that the reference edge 32*c* may be identified based on the detected edge points 47*a* and 47*b*. For example, a line connecting and between the detected edge points 47*a* and 47*b* may correspond to at least a portion of the reference edge 32*c*. In some examples, the reference edge 32*c* may be a media leading edge, a media trailing edge, and the like. The determination module 23 may apply the offset compensation parameter to the default printhead origin 42 to perform a print job and apply the angular compensation parameter to adjust a rotation of an image to be formed on the media 31. Thus, for example, the offset compensation parameter and the angular compensation parameter may be identified and applied with respect to the misaligned image 10*a* (FIG. 1A) to print an alignment-compensated image 10*b* (FIG. 1B). For example, a digital image file may be rotated, re-sized, cropped, and the like, in firmware prior to it being printed. Accordingly, identification and application of the offset compensation parameter and the angular compensation parameter by the printing system 200 may reduce and/or eliminate image horizontal shift and image skew.

Figure 5:
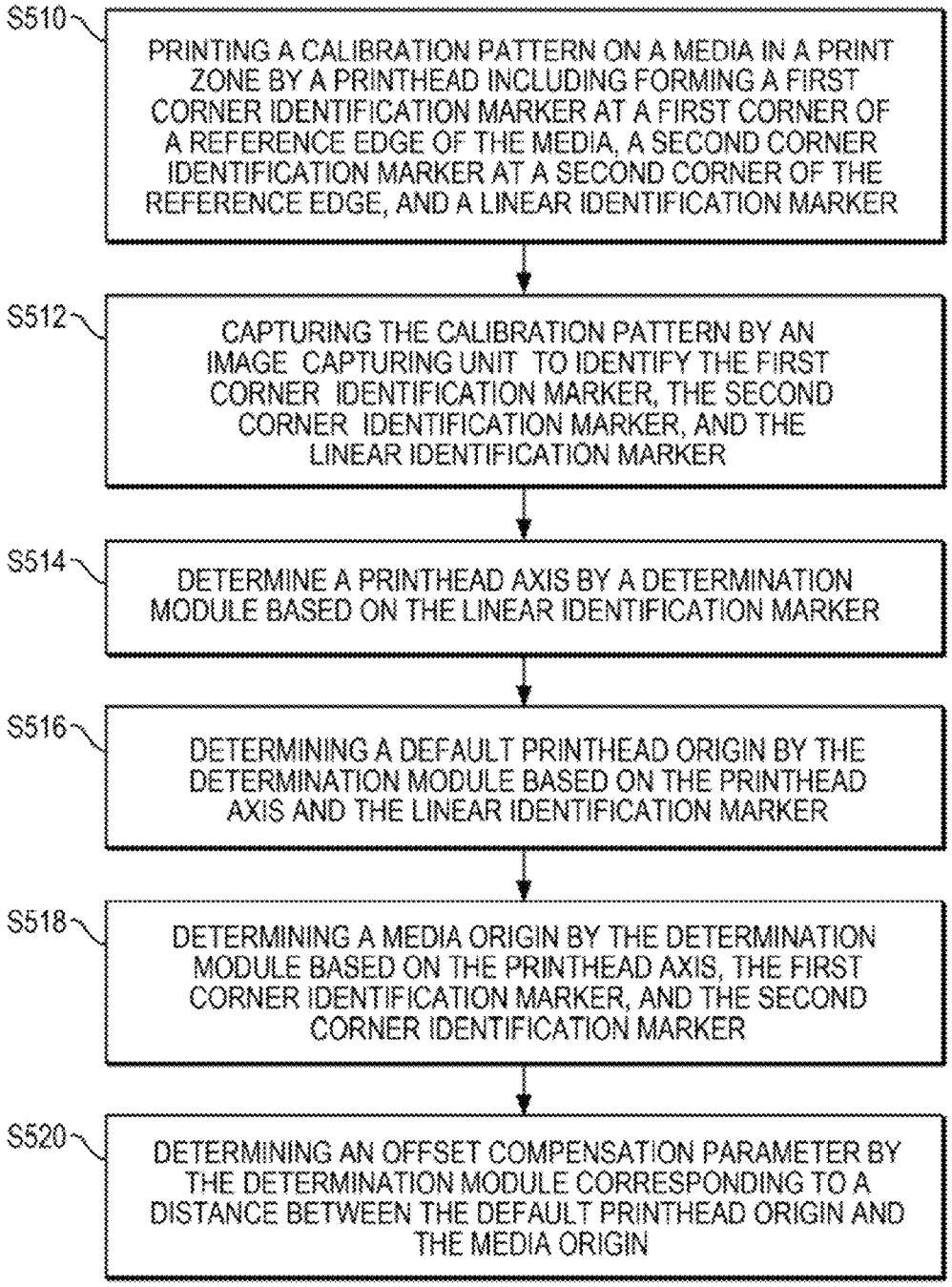
FIG. 5 is a flowchart illustrating a media alignment method of a printing system according to an example.

FIG. 5 is a flowchart illustrating a media alignment method of a printing system according to an example. Referring to FIG. 5, in block S510, a calibration pattern is printed on a media in a print zone by a printhead including forming a first corner identification marker at a first corner of a reference edge of the media, a second corner identification marker at a second corner of the reference edge, and a linear identification marker. For example, the first corner of the reference edge of the media may be tinted by forming a first swath through overspraying fluid at the first corner by the printhead and the second corner of the reference edge of the media may be tinted by forming a second swath through overspraying fluid at the second corner by the printhead. In some examples, printing a calibration pattern on a media in a print zone by a printhead may also include printing the calibration pattern including a plurality of nozzle alignment identification markers on the media in the print zone by an inkjet printhead having nozzles.

In block S512, the calibration pattern is captured by an image capturing unit to identify the first corner identification marker, the second corner identification marker, and the linear identification marker. In some examples, the image capturing unit may include a scanner to scan the calibration pattern. In block S514, a printhead axis is determined by a determination module based on the linear identification marker. In some examples, determining a printhead axis by a determination module based on the linear identification marker may include detecting the linear identification marker including the marker leading edge, the marker trailing edge, the first marker side edge, and the second marker side edge thereof. Determining the printhead axis may also include determining a pixel length of the linear identification marker based on the predetermined length thereof and identifying points equally spaced from the marker leading edge and the marker trailing edge of the linear identification marker.

In block S516, a default printhead origin is determined by the determination module based on the printhead axis and the linear identification marker. For example, a first pair of intersection points including a first point and a second point may be determined. The first point may be located at an intersection of the printhead axis and the first marker side edge of the linear identification marker. The second point may be located at an intersection of the printhead axis and the second marker side edge of the linear identification marker. Determining the default printhead origin may also include determining the default printhead origin based on a point equally spaced from the first point and the second point.

In block S518, a media origin is determined by the determination module based on the printhead axis, the first corner identification marker, and the second corner identification marker. For example, a second pair of intersection points including a third point and a fourth point may be determined. The third point may be located at an intersection of the printhead axis and a first media side edge of the media within the first corner identification marker. The fourth point may be located at the printhead axis and a second media side edge of the media within the second corner identification marker. Additionally, the media origin may be determined based on a point equally spaced from the third point and the fourth point. In block S520, an offset compensation parameter is determined by the determination module corresponding to a distance between the default printhead origin and the media origin.

In some examples, the method may also include the reference edge of the media being identified by the determination module based on the first and second corner identification markers. For example, edge points may be detected within the first and second corner identification markers on the reference edge of the media, respectively, such that the reference edge of the media may be identified based on the detected edge points. In some examples, the reference edge may be a media leading edge, a media trailing edge, and the like.

The method may also include an angular compensation parameter being determined by the determination module corresponding to a skew angle formed by the printhead axis and the reference edge of the media. The method may also include the angular compensation parameter being applied to adjust a rotation of an image to be formed on the media and the offset compensation parameter being applied to the default printhead origin by the determination module to perform a print job. For example, applying the offset compensation parameter to the default printhead origin may include determining a compensated printhead origin by adding the offset compensation parameter to the default printhead origin by the determination module to perform the print job. In some examples, the compensated printhead origin may be used to perform print jobs. Alternatively, the default printhead origin may be used to perform printhead functions not dependent on media alignment such as capping, uncapping, cleaning, spitting, and the like.

It is to be understood that the flowchart of FIG. 5 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 5 illustrates a specific order of execution, the order of execution may differ from that which is depicted. For example, the order of execution of two or more blocks may be rearranged relative to the order illustrated. Also, two or more blocks illustrated in succession in FIG. 5 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A media alignment method of a printing system, the method comprising:

printing a calibration pattern on a media in a print zone by a printhead including forming a first corner identification marker at a first corner by overspraying a first media side edge and a reference edge of the media, a second corner identification marker at a second corner by overspraying a second media side edge and the reference edge, and a linear identification marker of a predetermined length and having a marker leading edge, a marker trailing edge, a first marker side edge, and a second marker side edge and disposed between the first and second corner identification markers;

capturing the calibration pattern by an image capturing unit without the use of dedicated alignment sensors to identify the first corner identification marker, the second corner identification marker, and the linear identification marker;

determining a printhead axis by a determination module based on the linear identification marker by determining a pixel length based on the predetermined length and identifying points equally spaced from the marker leading edge and the marker trailing edge;

determining a default printhead origin by the determination module based on the printhead axis and the linear identification marker and equally spaced from a first point located at an intersection of the printhead axis and the first marker side edge and a second point located at an intersection of the printhead axis and the second marker side edge;

determining a media origin by the determination module based on the printhead axis, the first corner identification marker, and the second corner identification marker, and equally spaced from a third point located at an intersection between the printhead axis and the first media side edge and a fourth point located at an intersection between the printhead axis and the second media side edge; and determining an offset compensation parameter by the determination module corresponding to a distance between the default printhead origin and the media origin.

2. The media alignment method according to claim 1, further comprising:

applying the offset compensation parameter to the default printhead origin by the determination module to perform a print job.

3. The media alignment method according to claim 2, further comprising:

identifying the reference edge of the media by the determination module based on the first and second corner identification markers;

determining an angular compensation parameter by the determination module corresponding to a skew angle formed by the printhead axis and the identified reference edge of the media; and applying the angular compensation parameter to adjust a rotation of an image to be formed on the media by the determination module.

4. The media alignment method according to claim 3, wherein the identifying the reference edge of the media by the determination module based on the first and second corner identification markers further comprises:

detecting the first and second edge points within the first and second corner identification markers on the reference edge of the media, respectively; and identifying the reference edge of the media based on the detected first and second edge points.

5. The media alignment method according to claim 2, wherein applying the offset compensation parameter to the default printhead origin by the determination module to perform a print job further comprises:

determining a compensated printhead origin by adding the offset compensation parameter to the default printhead origin by the determination module to perform the print job.

6. The media alignment method according to claim 2, wherein the printing a calibration pattern on a media in a print zone by a printhead further comprises:

printing the calibration pattern including a plurality of nozzle alignment identification markers on the media in the print zone by the printhead having nozzles.

7. The media alignment method according to claim 1, wherein the forming the first corner identification marker includes tinting the first corner of the reference edge of the media by forming a first swath through overspraying fluid at the first corner by the printhead, and wherein the forming the second corner identification marker includes tinting the second corner of the reference edge by forming a second swath through overspraying fluid at the second corner by the printhead.

8. The media alignment method according to claim 7, wherein the forming a linear identification marker comprises:

printing a rectangular swath on the media.

9. A printing system, comprising:

a printhead having nozzles to print a calibration pattern on a media in a print zone to form a first corner identification marker at a first corner by overspraying a first media edge and a reference edge of the media, a second corner identification marker at a second corner by overspraying a second media edge and the reference-edge, and a linear identification marker of a predetermined length and having a marker leading edge, a marker trailing edge, a first marker side edge, a second marker side edge disposed between the first and second corner identification markers, and nozzle alignment identification markers;

an image capturing unit to capture the calibration pattern without the use of dedicated alignment sensors to identify the first corner identification marker, the second corner identification marker, the linear identification marker, and the nozzle alignment identification markers; and a determination module to determine a printhead axis based on the linear identification marker by determining a pixel length based on the predetermined length and identifying points equally spaced from the marker leading edge and the marker trailing edge, a default printhead origin based on the printhead axis and the linear identification marker and equally spaced from a first point located at an intersection of the printhead axis and the first marker side edge and a second point located at an intersection of the printhead axis and the second marker side edge, a media origin based on the printhead axis and the first and second corner identification markers, and equally spaced from a third point located at an intersection between the printhead axis and the first media side edge and a fourth point located at an intersection between the printhead axis and the second media side edge, and an offset compensation parameter corresponding to a distance between the default printhead origin and the media origin.

10. The printing system according to claim 9, wherein the determination module is configured to apply the offset compensation parameter to the default printhead origin to perform a print job.

11. The printing system according to claim 10, wherein the determination module is configured to identify the reference edge of the media based on the first and second corner identification markers, to determine an angular compensation parameter corresponding to a skew angle formed by the printhead axis and the identified reference edge of the media, and to apply the angular compensation parameter to adjust a rotation of an image to be formed on the media.

* * * * *